US009535352B2

(12) United States Patent
Ojima

(10) Patent No.: US 9,535,352 B2
(45) Date of Patent: Jan. 3, 2017

(54) ELECTROSTATIC LATENT IMAGE DEVELOPING TONER AND MANUFACTURING METHOD OF THE SAME

(71) Applicant: KYOCERA Document Solutions Inc., Osaka (JP)

(72) Inventor: Seishi Ojima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/922,721

(22) Filed: Oct. 26, 2015

(65) Prior Publication Data

US 2016/0116856 A1 Apr. 28, 2016

(30) Foreign Application Priority Data

Oct. 27, 2014 (JP) ..... 2014-218409

(51) Int. Cl.
*G03G 9/093* (2006.01)
*G03G 9/08* (2006.01)

(52) U.S. Cl.
CPC ..... *G03G 9/09342* (2013.01); *G03G 9/0819* (2013.01); *G03G 9/09392* (2013.01)

(58) Field of Classification Search
CPC ... G03G 9/093; G03G 9/0827; G03G 9/09385
See application file for complete search history.

(56) References Cited

U.S. PATENT DOCUMENTS 4,740,443 A * 4/1988 Nakahara ..... G03G 9/0825 430/108.24
6,733,940 B2 5/2004 Terao et al.
8,216,758 B2 7/2012 Yamada et al.
2003/0027069 A1 2/2003 Terao et al.
2005/0175921 A1* 8/2005 Morris ..... G03G 9/0804 430/109.3
2005/0271964 A1 12/2005 Etou et al.
2009/0297225 A1 12/2009 Yamada et al.
2010/0266942 A1* 10/2010 Ono ..... G03G 9/0819 430/107.1

FOREIGN PATENT DOCUMENTS

JP H06-170214 A 6/1994
JP 2002-304016 A 10/2002
JP 2004-138985 A 5/2004
JP 2006-276069 * 10/2006 ..... G03G 9/08
JP 2006-276069 A 10/2006
JP 2009-288566 A 12/2009
JP 2011-033986 A 2/2011
JP 2014-071418 A 4/2014

OTHER PUBLICATIONS

Translation of JP 2006-276069.*
An Office Action; "Notice of Reasons for Rejection," issued by the Japanese Patent Office on Jun. 28, 2016, which corresponds to Japanese Patent Application No. 2014-218409 and is related to U.S. Appl. No. 14/922,721.

* cited by examiner

*Primary Examiner* — Peter Vajda
(74) *Attorney, Agent, or Firm* — Studebaker & Brackett PC

(57) ABSTRACT

An electrostatic latent image developing toner includes toner particles that each include a toner mother particle. The toner mother particle includes a toner core, a shell layer disposed over a surface of the toner core, and inorganic particles. The inorganic particles are located at an interface between the toner core and the shell layer, or within the shell layer. The shell layer contains a thermosetting component. The toner mother particle has a BET specific surface area of at least 0.95 $m^2/g$.

13 Claims, No Drawings

ELECTROSTATIC LATENT IMAGE DEVELOPING TONER AND MANUFACTURING METHOD OF THE SAME

INCORPORATION BY REFERENCE

The present application claims priority under 35 U.S.C. §119 to Japanese Patent Application No. 2014-218409, filed on Oct. 27, 2014. The contents of this application are incorporated herein by reference in their entirety.

BACKGROUND

The present disclosure relates to an electrostatic latent image developing toner and a manufacturing method of the same.

A toner that has favorable fixability even when heating thereof by a fixing roller is kept at a minimal level is preferable in terms of energy efficiency and device miniaturization. In one known example proposed in relation to an objective of obtaining a toner having excellent low-temperature fixability, toner particles have a capsule structure in which shell layers formed from a resin coat toner cores containing a binder resin that has a low melting point. The resin forming the shell layers has a higher glass transition point than a glass transition point ($Tg^c$) of the binder resin contained in the toner cores. In another known example, toner particles having a capsule structure such as described above are used as toner mother particles and inorganic particles are added onto the surfaces of the toner mother particles as an external additive in order to improve fluidity and handleability.

In one such known example in which inorganic particles are added to toner mother particles having a capsule structure, silica is used as the inorganic particles added to the toner mother particles as an external additive.

SUMMARY

An electrostatic latent image developing toner according to the present disclosure includes toner particles that each include a toner mother particle. The toner mother particle includes a toner core, a shell layer disposed over a surface of the toner core, and inorganic particles. The inorganic particles are located at an interface between the toner core and the shell layer, or within the shell layer. The shell layer contains a thermosetting component. The toner mother particle has a BET specific surface area of at least 0.95 $m^2/g$.

DETAILED DESCRIPTION

The following explains an embodiment of the present disclosure in detail. However, the present disclosure is not in any sense limited by the following embodiment and can be implemented with appropriate alterations within the intended scope of the present disclosure. Although explanation is omitted as appropriate in some instances in order to avoid repetition, such omission does not limit the essence of the present disclosure. Unless otherwise stated, evaluation results (for example, values indicating shape and physical properties) for a powder (specific examples include toner cores, toner mother particles, external additive, and toner) are number averages of values measured for a suitable number of particles. Note that in the present description, the term "-based" may be appended to the name of a chemical compound in order to form a generic name encompassing both the chemical compound itself and derivatives thereof.

Also, when the term "-based" is appended to the name of a chemical compound used in the name of a polymer, the term indicates that a repeating unit of the polymer originates from the chemical compound or a derivative thereof. Note that in the present description, the term "(meth)acryl" is used as a generic term for both acryl and methacryl.

An electrostatic latent image developing toner (also referred to below as a toner) according to the present embodiment includes toner particles. Each of the toner particles includes a toner core, a shell layer disposed over the surface of the toner core, and inorganic particles. It is preferable that the toner cores are anionic and that the shell layers are cationic. As a result of the toner cores being anionic, a cationic shell layer material can be attracted toward the surfaces of the toner cores during formation of the shell layers. Furthermore, a reaction of a thermosetting component or the like adhering to the toner cores proceeds favorably at the surfaces of the toner cores. Therefore, the shell layers can be formed uniformly without using a dispersant. As explained further below, in some instances, an external additive may be added to the surfaces of toner particles. In the present specification, the term "toner mother particle" is used to refer to a toner particle without an external additive adhering thereto.

The toner cores preferably contain a binder resin. The shell layers contain a thermosetting component and are formed such as to coat the surfaces of the toner cores. The inorganic particles are located at interfaces between the toner cores and the shell layers, or within the shell layers.

The following explains components contained in the toner cores. The toner cores can contain a binder resin and are preferably anionic. The binder resin for example has an ester group, a hydroxyl group, a carboxyl group, an amino group, an ether group, an acid group, or a methyl group as a functional group. The binder resin preferably has at least one functional group selected from the group consisting of a hydroxyl group, a carboxyl group, and an amino group in molecules thereof, and more preferably has either or both of a hydroxyl group and a carboxyl group in molecules thereof. The reason for the above is that such functional groups react to form chemical bonds with a thermosetting component (for example, methylol melamine) contained in a resin that forms the shell layers. As a result, shell layers strongly bond to toner cores manufactured from a binder resin including a functional group such as described above.

In a situation in which the binder resin has a carboxyl group, the binder resin preferably has an acid value of at least 3 mg KOH/g and no greater 50 mg KOH/g, and more preferably at least 10 mg KOH/g and no greater than 40 mg KOH/g, in order that the binder resin is anionic.

In a situation in which the binder resin has a hydroxyl group, the binder resin preferably has a hydroxyl value of at least 10 mg KOH/g and no greater 70 mg KOH/g, and more preferably at least 15 mg KOH/g and no greater than 50 mg KOH/g, in order that the binder resin is anionic The binder resin preferably has a solubility parameter (SP value) of at least 10, and more preferably at least 15. SP values in the present embodiment are represented by the square root of molecular cohesive energy. SP values can for example be calculated in accordance with a method described in R. F. Fedors, Polymer Engineering Science, 14, p147 (1974). SP values are in units of $(MPa)^{1/2}$. SP values in the present embodiment are values at 25° C.

Specific examples of the binder resin include thermoplastic resins (for example, styrene resins, acrylic acid-based resins, styrene-acrylic acid-based resins, polyethylene resins, polypropylene resins, vinyl chloride resins, polyester resins, polyamide resins, polyurethane resins, polyvinyl alcohol resins, vinyl ether resins, N-vinyl resins, and styrene-butadiene resins). In order to improve colorant dispersibility in the toner, chargeability, and fixability to a recording medium, the binder resin includes preferably either or both of a styrene-acrylic acid-based resin and a polyester resin.

The styrene-acrylic acid-based resin is a copolymer of a styrene-based monomer and an acrylic acid-based monomer. Specific examples of the styrene-based monomer include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Specific examples of the acrylic acid-based monomer include (meth)acrylic acid, alkyl (meth)acrylates (for example, methyl (meth)acrylate, ethyl (meth)acrylate, n-propyl (meth)acrylate, iso-propyl (meth)acrylate, n-butyl (meth)acrylate, 2-ethylhexyl (meth)acrylate, or iso-butyl (meth)acrylate), and hydroxyalkyl (meth)acrylates (for example, 2-hydroxyethyl (meth)acrylate, 3-hydroxypropyl (meth)acrylate, 2-hydroxypropyl (meth)acrylate, or 4-hydroxybutyl (meth)acrylate).

A hydroxyl group can be introduced into the styrene-acrylic-acid based resin by using a monomer having a hydroxyl group (for example, p-hydroxystyrene, m-hydroxystyrene, or a hydroxyalkyl (meth)acrylate) in preparation of the styrene-acrylic acid-based resin. A hydroxyl value of the styrene-acrylic acid-based resin can be adjusted by appropriately adjusting the amount of the monomer having the hydroxyl group.

A carboxyl group can be introduced into the styrene-acrylic acid-based resin by using (meth)acrylic acid as a monomer in preparation of the styrene-acrylic acid-based resin. An acid value of the styrene-acrylic acid-based resin can be adjusted by appropriately adjusting the amount of (meth)acrylic acid.

The polyester resin can be obtained through polycondensation or condensation copolymerization of a di-, tri-, or higher-hydric alcohol component and a di-, tri-, or higher-basic carboxylic acid component.

Examples of the di-hydric alcohol component include diols (for example, ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, or polytetramethylene glycol) and bisphenols (for example, bisphenol A, hydrogenated bisphenol A, polyoxyethylene bisphenol A ether, or polyoxypropylene bisphenol A ether).

Examples of the tri- or higher-hydric alcohol component include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of the di-basic carboxylic acid component include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, alkyl succinic acids (for example n-butylsuccinic acid, isobutylsuccinic acid, n-octylsuccinic acid, n-dodecylsuccinic acid, or isododecylsuccinic acid), and alkenyl succinic acids (for example, n-butenylsuccinic acid, isobutenylsuccinic acid, n-octenylsuccinic acid, n-dodecenylsuccinic acid, or isododecenylsuccinic acid).

Examples of the tri- or higher-basic carboxylic acid component include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid. Alternatively, an ester-forming derivative of any of the di-, tri-, or higher-basic carboxylic acid components listed above may be used (for example, an acid halide, an acid anhydride, or a lower alkyl ester). The term lower alkyl refers to an alkyl group having a carbon number of 1-6.

An acid value and a hydroxyl value of the polyester resin can be adjusted by appropriately adjusting the respective amounts of the di-, tri-, or higher-hydric alcohol component and the di-, tri-, or higher-basic carboxylic acid component used in preparation of the polyester resin. An increase in molecular weight of the polyester resin tends to result in a decrease in the acid value and the hydroxyl value of the polyester resin.

In order to inhibit aggregation of the toner cores during formation of the shell layers, the binder resin preferably has a glass transition point Tg of at least 20° C., and more preferably at least 30° C. In order to improve fixability, the glass transition point Tg of the binder resin is preferably no greater than a curing onset temperature of the thermosetting component contained in the shell layers. As the curing onset temperature of the thermosetting component is typically about 55° C., the glass transition point Tg of the binder resin is preferably no greater than 55° C., and more preferably no greater than 50° C.

The glass transition point Tg of the binder resin can be obtained from a point of change of specific heat of the binder resin using a differential scanning calorimeter (DSC). For example, the glass transition point Tg of the binder resin is obtained by using a differential scanning calorimeter (for example, a DSC-6220 produced by Seiko Instruments Inc.) as a measuring device to plot a heat absorption curve for the binder resin. A specific example of a method for obtaining the glass transition point Tg of the binder resin involves placing 10 mg of a measurement sample in an aluminum pan, plotting a heat absorption curve for the binder resin in a measurement temperature range of 25° C. to 200° C. and with a heating rate of 10° C./minute using an empty aluminum pan as a reference, and obtaining the glass transition point Tg of the binder resin based on the heat absorption curve.

The binder resin preferably has a softening point Tm of no greater than 100° C., and more preferably no greater than 95° C. A softening point Tm of no greater than 100° C. ensures that sufficient fixability can be achieved even during high speed fixing. The softening point Tm of the binder resin can for example be adjusted by forming the binder resin from a combination of binder resins having different softening points Tm.

The softening point Tm of the binder resin can be measured using a capillary rheometer (for example, a CFT-500D produced by Shimadzu Corporation). More specifically, measurement involves setting a measurement sample in the capillary rheometer, plotting an S-shaped curve (curve of stroke (mm)/temperature (° C.)) by causing melt-flow of 1 $cm^3$ of the sample under specific conditions (die pore diameter 1 mm, plunger load 20 $kg/cm^2$, heating rate 6° C./minute), and reading the softening point Tm of the binder resin from the S-shaped curve.

In a situation in which the binder resin is a polyester resin, a number average molecular weight Mn of the polyester resin is preferably at least 1,000 and no greater than 2,000 in order to improve fixability and strength of the toner cores. For the same reason as given above, the polyester resin preferably has a molecular weight distribution (ratio of mass average molecular weight Mw to number average molecular weight Mn, mass average molecular weight Mw/number average molecular weight Mn) of at least 9 and no greater than 21.

In a situation in which the binder resin is a styrene-acrylic acid-based resin, a number average molecular weight Mn of the styrene-acrylic acid-based resin is preferably at least 2,000 and no greater than 3,000 in order to improve fixability and strength of the toner cores. For the same reason as given above, the styrene-acrylic acid-based resin preferably has a molecular weight distribution of at least 10 and no greater than 20. The number average molecular weight Mn and the mass average molecular weight Mw of the binder resin can for example be measured by gel permeation chromatography.

The toner cores may contain a known pigment or dye matching a color of the toner particles as a colorant. Carbon black can for example be used as a black colorant. Alternatively, a colorant that is adjusted to a black color using a yellow colorant, a magenta colorant, and a cyan colorant can for example be used as a black colorant.

In the case of toner particles of a color toner, a yellow colorant, a magenta colorant, or a cyan colorant can for example be provided as a colorant in the toner cores.

Examples of the yellow colorant include condensed azo compounds, isoindolinone compounds, anthraquinone compounds, azo metal complexes, methine compounds, and arylamide compounds. Specific example includes C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

Examples of the cyan colorant include copper phthalocyanine compounds, anthraquinone compounds, and basic dye lake compounds. Specific examples include C.I. Pigment Blue (1, 7, 15, 15:1, 15:2, 15:3, 15:4, 60, 62, or 66), Phthalocyanine Blue, C.I. Vat Blue, and C.I. Acid Blue.

The amount of the colorant is preferably at least 1 part by mass and no greater than 20 parts by mass relative to 100 parts by mass of the binder resin, and more preferably at least 3 parts by mass and no greater than 10 parts by mass.

The toner cores may optionally contain a releasing agent in order to improve offset resistance and fixability of the toner particles. Examples of the releasing agent include aliphatic hydrocarbon-based waxes (for example, low molecular weight polyethylene, low molecular weight polypropylene, polyolefin copolymer, polyolefin wax, microcrystalline wax, paraffin wax, or Fischer-Tropsch wax), oxides of aliphatic hydrocarbon-based waxes (for example, polyethylene oxide wax or block copolymer of polyethylene oxide wax), plant waxes (for example, candelilla wax, carnauba wax, Japan wax, jojoba wax, or rice wax), animal waxes (for example, beeswax, lanolin, or spermaceti), mineral waxes (for example, ozokerite, ceresin, or petrolatum), waxes having a fatty acid ester as a main component (for example, montanic acid ester wax or castor wax), and waxes in which a fatty acid ester is partially or fully deoxidized (for example, deoxidized carnauba wax).

In order to improve offset resistance and fixability of the toner particles, the amount of the releasing agent is preferably at least 1 part by mass and no greater than 30 parts by mass relative to 100 parts by mass of the binder resin, and more preferably at least 5 parts by mass and no greater than 20 parts by mass.

The toner cores may optionally contain a charge control agent in order to improve a charge rise characteristic and obtain a toner having excellent durability and stability. The charge rise characteristic is an indicator of whether or not charging can be performed to a specific charge level in a short time. As the toner cores are anionic (negatively chargeable), a negatively chargeable charge control agent can be used.

The toner cores may optionally contain a magnetic powder, depending on necessity thereof. In a situation in which the toner according to the present embodiment includes toner particles that are prepared using toner cores containing a magnetic powder, the toner is used as a magnetic one component developer. Examples of preferable magnetic powders include iron (for example, ferrite or magnetite), ferromagnetic metals (for example, cobalt or nickel), alloys including either or both of iron and a ferromagnetic metal, compounds including either or both of iron and a ferromagnetic metal, ferromagnetic alloys subjected to ferromagnetization (for example, heat treatment), and chromium dioxide.

The magnetic powder preferably has an average particle size of at least 0.1 μm and no greater than 1.0 μm, and more preferably at least 0.1 μm and no greater than 0.5 μm. A magnetic powder having an average particle size of at least 0.1 μm and no greater than 1.0 μm tends to be easier to uniformly disperse in the binder resin.

In a situation in which the toner according to the present embodiment is used as a one component developer, the amount of the magnetic powder is preferably at least 35 parts by mass and no greater than 60 parts by mass relative to 100 parts by mass of the toner overall, and more preferably at least 40 parts by mass and no greater than 60 parts by mass. In a situation in which the toner according to the present embodiment is used in a two component developer, the amount of the magnetic powder is preferably no greater than 20 parts by mass relative to 100 parts by mass of the toner overall, and more preferably no greater than 15 parts by mass.

In the present embodiment, the toner cores having a negative zeta potential when measured in an aqueous medium adjusted to pH 4 is taken as an indicator that the toner cores are anionic. In order that the toner cores have favorable anionic strength, the aforementioned zeta potential is preferably no greater than −10 mV.

Another example of an indicator that the toner cores are anionic is a triboelectric charge of no greater than −10 μC/g with a standard carrier. Triboelectric charge is an indicator of whether charging occurs to positive or negative polarity and of the ease with which charging occurs.

The following explains the shell layers in detail. First, an explanation of the resin forming the shell layers is provided. In order to improve strength and hardness and impart sufficient cationic strength on the shell layers, the resin forming the shell layers preferably contains a thermosetting component. The thermosetting component for example has a unit in which a methylene group (—$CH_2$—) derived from formaldehyde is introduced into a melamine monomer.

Examples of monomers for introducing the thermosetting component into the resin include monomers and prepolymers for forming a melamine resin, a guanamine resin, a sulfonamide resin, a urea resin, a glyoxal resin, an aniline resin, or a polyimide resin. The monomer for introducing the thermosetting component into the resin is preferably a monomer or a prepolymer for forming one or more types of resin selected from the group consisting of a melamine resin, a urea resin, and a glyoxal resin.

The melamine resin is a polycondensate of melamine and formaldehyde. The melamine resin is formed using melamine as a monomer. The urea resin is a polycondensate of urea and formaldehyde. The urea resin is formed using urea as a monomer. The glyoxal resin is a polycondensate of formaldehyde and a reaction product of glyoxal and urea. The glyoxal resin is formed using the reaction product of glyoxal and urea as a monomer. Melamine and urea may be modified in a known manner. The resin forming the shell layers may optionally include a thermoplastic component. In such a situation, the monomer used to introduce the thermosetting component into the resin forming the shell layer may include a derivative that is methylolated using formaldehyde prior to reaction with the thermoplastic component.

The shell layers preferably contain nitrogen atoms that for example originate from melamine or urea. Materials containing nitrogen atoms tend to be easily charged to positive polarity. In order that the toner particles can be easily charged to a desired positive charge, the shell layers preferably contain at least 10% by mass of nitrogen atoms.

Formation of the shell layers is preferably carried out in an aqueous dispersion. The reason for the above is that the binder resin tends not to dissolve and the releasing agent, which is an optional component, tends not to elute in an aqueous dispersion. Therefore, in a situation in which a thermoplastic component is used in the shell layers, the thermoplastic component is preferably water-soluble.

In a situation in which the shell layers are formed in the aqueous dispersion without using a surfactant or a dispersant, toner particles that do not have a surfactant or dispersant present between the toner cores and the shell layers can be obtained. Such a configuration can inhibit detachment of the shell layers from the toner cores.

The shell layers preferably have a thickness of no greater than 20 nm, more preferably at least 1 nm and no greater than 20 nm, and particularly preferably at least 1 nm and no greater than 15 nm Shell layers having a thickness of no greater than 20 nm tend to be easily ruptured during fixing of the toner to a recording medium through, for example, application of heat and pressure. Consequently, softening or melting of the binder resin contained in the toner cores proceeds quickly such that the toner particles can be fixed to the recording medium at low temperatures. Furthermore, image formation can be performed appropriately because chargeability of the shell layers is not excessively high. Shell layers having a thickness of at least 1 nm are strong enough to inhibit rupturing thereof due to, for example, impact during transportation. Furthermore, image defects can be inhibited from occurring because the shell layer thickness of at least 1 nm ensures that chargeability of the shell layers is not too low.

The thickness of the shell layers can be measured by analyzing cross-sectional TEM images of the toner particles using commercially available image analysis software (for example, WinROOF produced by Mitani Corporation). More specifically, two straight lines that perpendicularly intersect at approximately the center of a cross-section of a measurement target toner particle are drawn and lengths of four segments where the two straight lines intersect the shell layer are measured. The thickness of the shell layer of the measurement target toner particle is taken to be an average value of the measured lengths of the four segments. In the present specification, shell layer thickness measurement is performed on at least 10 toner particles and an average value of the measured shell layer thicknesses is taken to be the thickness of the shell layers.

In a situation in which the shell layer is too thin, it may be difficult to measure the thickness of the shell layer due to an interface between the shell layer and the toner core being unclear in a TEM image. In such a situation, the thickness of the shell layer can be measured by using TEM imaging in combination with energy dispersive X-ray spectroscopic analysis (EDX) to clarify the interface between the shell layer and the toner core. More specifically, EDX can be used to perform mapping in a TEM image of an element that is characteristic of a material forming the shell layer (for example, nitrogen).

The shell layers may be subjected to a technique that facilitates rupturing of the shell layers upon application of heat or pressure. More specifically, preferably the surfaces of the toner cores are roughened prior to formation of the shell layers, or a wax, pigment, or silica particles are included in the shell layers. In such a configuration, the shell layers tend to be easily ruptured during fixing upon application of heat and pressure, with the unevenness of the surfaces of the toner cores or the resin, wax, pigment, or silica particles in the shell layers acting as an initiation point of rupturing. Consequently, softening or melting of the binder resin contained in the toner cores proceeds quickly such that the toner particles can be fixed to a recording medium at low temperatures.

The following explains an example of a method that can be used to confirm the initiation point of rupturing of the shell layers. In a situation in which a polyester resin is mixed with the shell layers as an initiation point of rupturing, the method for example involves using an electron microscope to observe through holes that arise due to dissolution of the polyester resin when the toner particles are left in an alkaline activator at approximately pH 10.

The shell layers may optionally contain a charge control agent. As the shell layers are cationic (positively chargeable), the shell layers may contain a positively chargeable charge control agent.

Inorganic particles are present at interfaces between the toner cores and the shell layers of the toner particles (toner mother particles), or within the shell layers. Inclusion of the inorganic particles at the interfaces between the toner cores and the shell layers, or within the shell layers, enables adjustment of the BET specific surface area of the toner particles. Although no particular limitations are placed on the amount of the inorganic particles present at the interfaces between the toner cores and the shell layers, or within the shell layers, the amount of the inorganic particles is preferably at least 0.1 parts by mass and no greater than 2.0 parts by mass relative to 100 parts by mass of the toner cores, and more preferably at least 0.3 parts by mass and no greater than 1.8 parts by mass. As a result of the inorganic particles being present at the interfaces between the toner cores and the shell layers, or within the shell layers, polymerization stability of the shell layers can be improved and the shell layers can be formed uniformly as thin films coating the surfaces of the toner cores.

Examples of types of inorganic particles that may be present at the interfaces between the toner cores and the shell layers, or within the shell layers, include silica particles and particles of a metal oxide (for example, alumina, titanium oxide, magnesium oxide, zinc oxide, strontium titanate, or barium titanate). The inorganic particles preferably have a particle size of at least 1 nm and no greater than 20 nm, and more preferably at least 5 nm and no greater than 15 nm.

The BET specific surface area of the toner particles (toner mother particles) is at least 0.95 $m^2/g$, preferably at least 0.95 $m^2/g$ and no greater than 1.60 $m^2/g$, and more preferably at least 1.00 $m^2/g$ and no greater than 1.25 $m^2/g$. In a configuration in which the BET specific surface area is at least 0.95 $m^2/g$, excellent image quality can be achieved because reduction in toner fluidity can be limited. In a situation in which inorganic particles or the like are added to the toner particles in order to improve fluidity and handleability, a value for BET specific surface area that is measured after removing the inorganic particles would be expected to be within the range described above.

As explained further below, fluidity and handleability of toner particles (toner mother particles) having a capsule structure can be improved through external addition of inorganic particles to the toner particles (toner mother particles). Removal of the externally added inorganic particles can be performed by any generally used method. One example of a removal method is ultrasonic dispersion treatment. More specifically, toner (at least 1 g and no greater than 10 g) is added into an aqueous solution (at least 50 g and no greater than 200 g) of polyoxyethylene lauryl ether (at least 0.1% and no greater than 1.0%). Next, an ultrasonic cleaner is used to perform ultrasonic dispersion for at least 5 minutes and no greater than 20 minutes. The resultant dispersion is filtered using filter paper having a pore size of at least 0.5 μm and no greater than 10 μm in order to remove detached inorganic particles and collect a filter cake which is subsequently dried.

The toner particles preferably have a volume average particle size of at least 4.0 μm and no greater than 10.0 μm. The toner particles preferably have a number average particle size of at least 3.0 μm and no greater than 9.0 μm.

The toner particles may have a configuration in which a plurality of shell layers is disposed over the surface of each of the toner cores. In such a configuration, an outermost of the shell layers on the toner core is preferably cationic.

The following explains a different example of the toner particles included in the electrostatic latent image developing toner according to the present embodiment. In some instances, the surfaces of the toner particles may be treated using an external additive in order to improve fluidity and handleability of the toner particles. Examples of inorganic particles that can be used as the external additive include silica and metal oxides (for example, alumina, titanium oxide, magnesium oxide, zinc oxide, strontium titanate, or barium titanate). In order to improve fluidity and handleability, the external additive preferably has a particle size of at least 0.01 μm and no greater than 1.0 μm.

Also, in order to improve fluidity and handleability, the amount of the external additive is preferably at least 0.1 parts by mass and no greater than 10 parts by mass relative to 100 parts by mass of the toner mother particles, and more preferably at least 1 part by mass and no greater than 5 parts by mass.

The electrostatic latent image developing toner according to the present embodiment includes or consists of the toner particles. The electrostatic latent image developing toner according to the present embodiment can be used for a two component developer by mixing the electrostatic latent image developing toner with a desired carrier. The carrier is preferably a magnetic carrier. In one example of the carrier, carrier cores are coated with a resin. Specific examples of the carrier cores include: particles of iron, oxidized iron, reduced iron, magnetite, copper, silicon steel, ferrite, nickel, or cobalt; particles of an alloy of any of the above materials with a metal (for example, manganese, zinc, or aluminum); particles of iron-nickel alloy or iron-cobalt alloy; particles of ceramics (for example, titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate); and particles of high-dielectric substances (for example, ammonium dihydrogen phosphate, potassium dihydrogen phosphate, or Rochelle salt). Alternatively, the carrier cores may for example include the magnetic particles described above and a resin in which the magnetic particles are dispersed.

Examples of the resin coating the carrier cores include acrylic acid-based polymers, styrene-based polymers, styrene-acrylic acid-based copolymers, olefin-based polymers (polyethylene, chlorinated polyethylene, or polypropylene), polyvinyl chloride, polyvinyl acetate, polycarbonate, cellulose resins, polyester resins, unsaturated polyester resins, polyamide resins, polyurethane resins, epoxy resins, silicone resins, fluororesins (polytetrafluoroethylene, polychlorotrifluoroethylene, or polyvinylidene fluoride), phenolic resins, xylene resins, diallyl phthalate resins, polyacetal resins, and amino resins. Any one of the resins listed above or a combination of two or more of the resins can be used.

The carrier preferably has a particle size of at least 20 μm and no greater than 120 μm, and more preferably at least 25 μm and no greater than 80 μm. The particle size of the carrier can be measured by an electron microscope.

In a situation in which the electrostatic latent image developing toner according to the present embodiment is used in a two component developer, the amount of the toner is preferably at least 3% by mass and no greater than 20% by mass relative to the mass of the two component developer, and more preferably at least 5% by mass and no greater than 15% by mass.

The following explains a method of manufacturing the electrostatic latent image developing toner according to the present embodiment. The method of manufacturing the electrostatic latent image developing toner according to the present embodiment includes a process of preparing toner cores containing a binder resin (toner core preparation process) and a process of coating the toner cores with shell layers (shell layer formation process). Through the toner core preparation process and the shell layer formation process, toner particles in which toner cores are coated with shell layers can be obtained, and an electrostatic latent image developing toner including the toner particles can be manufactured.

It tends to be easy to coat the toner cores with the shell layers in a situation in which a surfactant or dispersant is used during shell layer formation. However, due to the surfactant or dispersant adhering to the surfaces of the toner cores, the shell layers are formed with the surfactant or dispersant present at the interfaces between the toner cores and the shell layers. In such a situation, bonding strength of the shell layers to the toner cores is affected by the surfactant or dispersant present at the interfaces and, as a result, the shell layers tend to readily detach from the toner cores when, for example, mechanical stress is applied to the toner particles. In contrast, in a situation in which a surfactant or dispersant is not used in the shell layer formation process of the manufacturing method according to the present embodiment, surfactant or dispersant is not present between the toner cores and the shell layers. Consequently, detachment of the shell layers from the toner cores can be inhibited.

Furthermore, surfactants and dispersants tend to have a very high effluent load. In a situation in which a surfactant or dispersant is not used, the total organic carbon concentration of effluent discharge in manufacturing of the toner particles can be kept at a low level of no greater than 15 mg/L without diluting the effluent.

When toner particles are manufactured using a surfactant or dispersant, a separate process is typically required in order to wash and remove the surfactant or dispersant (surfactant removal process). In some instances, the surfactant removal process may require an excessively large amount of water for washing. In the manufacturing method according to the present embodiment, the surfactant removal process can be omitted in a situation in which a surfactant or dispersant is not used. Therefore, the toner can be manufactured easily using a smaller amount of water and at lower cost.

The toner core preparation process should be performed by a method that enables favorable dispersion in the binder resin of components, other than the binder resin, that are included depending on necessity thereof (for example, a colorant, a charge control agent, a releasing agent, or a magnetic powder). A specific example of such a method is a melt-kneading method.

The following explains the toner core preparation process as performed according to the melt-kneading method. When the toner core preparation process is performed according to the melt-kneading method, the toner core preparation process is implemented through a mixing step, a melt-kneading step, a pulverizing step, and a classifying step. The mixing step involves mixing the binder resin and components other than the binder resin, depending on necessity thereof, to yield a mixture. The melt-kneading step involves melt-kneading of the resultant mixture to yield a melt-knead. The pulverizing step involves appropriate cooling to solidify the resultant melt-knead and subsequent pulverization by a known technique to yield a pulverized product. The classifying step involves classifying the pulverized product by a known technique to yield toner cores of desired particle size. By adopting the melt-kneading method, the toner cores can be easily manufactured without complication of the process.

Next, the shell layer formation process is explained below. In the shell layer formation process, shell layers are formed on the surfaces of the toner cores prepared as described above to manufacture toner particles in which the shell layers coat the toner cores.

The shell layers can be formed, for example, through a reaction of melamine, urea, or a reaction product of glyoxal and urea, and a precursor resulting from an addition reaction of formaldehyde and any of the above (methylolated product).

In the shell layer formation process, shell layer formation is preferably performed by adding a material for forming the shell layers into an aqueous dispersion containing the toner cores and dispersing the material.

In the shell layer formation process, the pH of the aqueous dispersion containing the toner cores is preferably adjusted to approximately pH 4. Adjusting the pH of the dispersion to an acidic pH of approximately 4 promotes a polycondensation reaction of the material used to form the shell layers. The pH adjustment of the aqueous dispersion containing the toner cores is preferably carried out prior to shell layer formation.

After the pH of the aqueous dispersion containing the toner cores is adjusted as necessary, the material for forming the shell layers is dissolved in the aqueous dispersion containing the toner cores. A reaction of the material for forming the shell layers is subsequently caused to proceed in the aqueous dispersion to form shell layers coating the surfaces of the toner cores.

The shell layer formation process is preferably carried out at a temperature of at least 40° C. and no greater than 95° C., and more preferably at least 50° C. and no greater than 80° C. Formation of the shell layers proceeds favorably when the shell layer formation process is carried out at a temperature of at least 40° C. and no greater than 95° C.

In a situation in which the binder resin includes a resin having a hydroxyl group or a carboxyl group (for example, a polyester resin), hydroxyl groups or carboxyl groups exposed at the surfaces of the toner cores react with methylol groups of the thermosetting component when shell layer formation is carried out at a temperature of at least 40° C. and no greater than 95° C. Strong adhesion of the shell layers to the toner cores can be achieved as a result of the above reaction, in which, covalent bonds are formed between the binder resin contained in the toner cores and the resin contained in the shell layers.

Once the shell layers have been formed in the shell layer formation process, the aqueous dispersion containing the toner cores coated with the shell layers can be cooled to room temperature to yield a dispersion of toner particles (toner mother particles). The toner particles are subsequently collected from the toner particle dispersion by carrying out one or more steps selected from among a washing step, a drying step, and an external addition step, depending on necessity thereof. The toner particles may be used as an electrostatic latent image developing toner as collected or may be used as an electrostatic latent image developing toner after other components are added thereto.

The washing step involves washing the toner mother particles (toner particles) using water. One example of a preferable washing method involves collecting a wet cake of the toner particles from the aqueous dispersion through solid-liquid separation and washing the resultant wet cake with water. Another example of a preferable washing method involves causing sedimentation of the toner particles contained in the aqueous dispersion, replacing a supernatant with water, and re-dispersing the toner mother particles (toner particles) in water after the replacement.

The drying step for example involves using a dryer (for example, a spray dryer, a fluidized bed dryer, a vacuum freeze dryer, or a reduced pressure dryer) to dry the toner mother particles (toner particles) after collection or washing thereof. The drying step is preferably performed using a spray dryer because the spray dryer tends to inhibit aggregation of the toner particles during drying. The spray dryer can be used to spray a dispersion of the toner mother particles (toner particles) and a dispersion of an external additive (for example, silica particles) together. Consequently, the external addition step explained below can be carried out at the same time as the drying step.

The external addition step involves causing an external additive to adhere to the surfaces of the toner mother particles (toner particles). One example of a preferable method for causing adhesion of the external additive involves mixing the toner mother particles (toner particles) with the external additive using a mixer (for example, an FM mixer or a Nauta mixer (registered Japanese trademark)), under external addition conditions that are adjusted to ensure that the external additive does not become embedded in the surfaces of the toner mother particles (toner particles), to yield toner particles.

The electrostatic latent image developing toner according to present embodiment has excellent polymerization stability and exhibits excellent printing quality even if an external additive is not added or becomes detached. Therefore, the electrostatic latent image developing toner can be advantageously used in an image forming apparatus that adopts a technique such as electrophotography.

EXAMPLES

The following provides more specific explanation of the present disclosure through examples. However, the present disclosure is not limited to the following examples.

Example 1

Low-Melting Point Toner Core Preparation

A polyester resin used to prepare toner cores had physical properties of a hydroxyl value of 20 mg KOH/g, an acid value of 40 mg KOH/g, a softening point Tm of 90° C., a glass transition point Tg of 49° C., and a solubility parameter (SP value) of 11.2.

The polyester resin was combined with 5 parts by mass of a phthalocyanine pigment 15:3 and 5 parts by mass of an ester wax relative to 100 parts by mass of the polyester resin, and was mixed using an FM mixer. After mixing, chips kneaded by a PCM-30 kneading device were pulverized to 6 μm by a Turbo Mill. Next, classification was performed by an Elbow Jet to yield toner cores having an average particle size of 6 μm. The toner cores had a number average roundness of 0.93. The toner cores had a glass transition point Tg of 51° C. and a softening point Tm of 91° C. The toner cores had a charge of −20 μC/g as measured using a standard carrier N-01. Furthermore, the toner cores had a zeta potential of −15 mV as measured at pH 4, which clearly indicates that the toner cores were anionic. The average particle size of the toner cores was measured according to the following method. The toner cores were dispersed in a dilute liquid of Coulter Isoton II (produced by Beckman Coulter, Inc.) using an anionic surfactant (Emal 0 produced by Kao Corporation, component: sodium lauryl sulfate). The average particle size of the toner cores in the resultant dispersion was measured using a precision particle size distribution analyzer (Coulter Counter Multisizer 3 produced by Beckman Coulter, Inc.).

[Inorganic Particle Addition Treatment of Toner Cores]

An FM mixer was used to perform mixing for 5 minutes of 1 kg of the toner cores and 15 g of silica subjected to positive charging treatment (Aerosil (registered Japanese trademark) 200 produced by Nippon Aerosil Co., Ltd., particle size 12 nm) as inorganic particles.

[Shell Layer Formation Process]

A three-necked flask having a capacity of 1 L was set up in a water bath at 30° C. and 300 mL of ion exchanged water was adjusted to pH 4 using a 1 mol/L aqueous solution of p-toluenesulfonic acid. Next, 2 mL of an aqueous solution of hexamethylol melamine prepolymer (Mirbane (registered Japanese trademark) resin SM-607 produced by Showa Denko K.K., solid concentration 80% by mass) was added to the pH adjusted liquid such that a 6 nm film could be formed. Subsequently, 300 g of the toner cores described above that had been subjected to the inorganic particle addition treatment were added to the resultant aqueous solution. Sufficient stirring of the aqueous solution was performed after addition of the toner cores. After a further 300 mL of ion exchanged water was added to the aqueous solution, the aqueous solution was heated at a rate of 1° C./minute under stirring, and was subsequently maintained at 70° C. for 2 hours. Next, the aqueous solution was cooled to room temperature and neutralized to pH 7. Filtration, washing, and drying were then performed to yield toner mother particles.

[Inorganic Particle Addition Treatment of Toner Mother Particles]

A UM mixer was used to perform 5 minutes of mixing of 200 g of the toner mother particles and 3.0 g silica subjected to positive charging treatment (Aerosil (registered Japanese trademark) 200 produced by Nippon Aerosil Co., Ltd., particle size 12 nm) as inorganic particles. The above process yielded a toner according to Example 1.

Example 2

A toner according to Example 2 was prepared in the same way as the toner according to Example 1 in all aspects other than that 10 g of silica (Aerosil (registered Japanese trademark) 200 produced by Nippon Aerosil Co., Ltd., particle size 12 nm) was added as the inorganic particles in the inorganic particle addition treatment of the surfaces of the toner cores.

Example 3

A toner according to Example 3 was prepared in the same way as the toner according to Example 1 in all aspects other than that 7.5 g of silica (Aerosil (registered Japanese trademark) 200 produced by Nippon Aerosil Co., Ltd., particle size 12 nm) was added as the inorganic particles in the inorganic particle addition treatment of the surfaces of the toner cores.

Example 4

A toner according to Example 4 was prepared in the same way as the toner according to Example 1 in all aspects other than that 5.0 g of silica (Aerosil (registered Japanese trademark) 200 produced by Nippon Aerosil Co., Ltd., particle size 12 nm) was added as the inorganic particles in the organic particle addition treatment of the surfaces of the toner cores.

Example 5

A toner according to Example 5 was prepared in the same way as the toner according to Example 2 in all aspects other than the amount of the aqueous solution of hexamethylol melamine prepolymer (Mirbane (registered Japanese trademark) resin SM-607 produced by Showa Denko K.K., solid concentration 80% by mass) was 3 mL.

Example 6

A toner according to Example 6 was prepared in the same way as the toner according to Example 2 in all aspects other than that the amount of the aqueous solution of hexamethylol melamine prepolymer (Mirbane (registered Japanese trademark) resin SM-607 produced by Showa Denko K.K., solid concentration 80% by mass) was 4 mL.

Example 7

A toner according to Example 7 was prepared in the same way as the toner according to Example 1 in all aspects other than that 10 g of titanium oxide (JMT150AN produced by Tayca Corporation, particle size 15 nm) was added as the inorganic particles in the inorganic particle addition treatment of the surfaces of the toner cores.

Example 8

A toner according to Example 8 was prepared in the same way as the toner according to Example 1 in all aspects other than that 7.5 g of titanium oxide (JMT150AN produced by Tayca Corporation, particle size 15 nm) was added as the inorganic particles in the inorganic particle addition treatment of the surfaces of the toner cores.

Comparative Example 1

A toner according to Comparative Example 1 was prepared in the same way as the toner according to Example 1 in all aspects other than that inorganic particle addition treatment was not performed on the surfaces of the toner cores.

Comparative Example 2

A toner according to Comparative Example 2 was prepared in the same way as the toner according to Example 2 in all aspects other than that the amount of the aqueous solution of hexamethylol melamine prepolymer (Mirbane (registered Japanese trademark) resin SM-607 produced by Showa Denko K.K., solid concentration 80% by mass) was 6 mL.

[Evaluation Methods]

The toners according to Examples 1-8 and Comparative Examples 1 and 2 were evaluated and measured according to the following methods.

(BET Specific Surface Area Measurement Method)

With respect to each of the toners according to Examples 1-8 and Comparative Examples 1 and 2, 5 g of the toner was added to 100 g of a 0.5% aqueous solution of Emulgen 120 (produced by Kao Corporation). Next, ultrasonic dispersion was performed for 10 minutes using an ultrasonic cleaner (Vs-F100 produced by As One Corporation, 50 kHz, 100 W). The resultant dispersion was filtered using filter paper having a pore size of 1 μm in order to remove detached inorganic particles. The filter cake was collected and dried to obtain particles. Next, the BET specific surface area of 3 g of the obtained particles was measured using a BET specific surface area measuring device (Macsorb Model-1208 (product name) produced by Mountech Co., Ltd.).

(Number Average Roundness Measurement)

Number average roundness was measured for each of Examples 1-8 and Comparative Examples 1 and 2 using an average roundness measuring device (FPIA (registered Japanese trademark) 3000 produced by Sysmex Corporation).

(Shell Layer Film Thickness Measurement Method)

Toner was sufficiently dispersed in cold-setting epoxy resin and left to harden for 2 days at an ambient temperature of 40° C. to yield a hardened product. The hardened material was dyed with osmium tetroxide and was then cut using a microtome equipped with a diamond knife to obtain a flake shaped sample. The film thickness of the shell layers was measured by observing a cross-section of the toner using a transmission electron microscope (TEM). However, in a situation in which the shell layers had a thickness of smaller then 5 nm and were thus difficult to distinguish using the transmission electron microscope, nitrogen mapping was performed by electron energy loss spectroscopy (TEM-EELS) in order to determine the film thickness.

(Evaluation of Image Density Maintainability)

With respect to each of the toners according to Examples 1-8 and Comparative Examples 1 and 2, the toner was loaded into a printer FS-05300DN produced by KYOCERA Document Solutions Inc. and after adjusting an initial printing image density to 1.3, printing of 2,000 sheets was performed with a B/W ratio of 1.5%. Image density was measured after printing 2,000 sheets and was used to evaluate image density maintainability in accordance with the following evaluation standard.

Particularly good: Image density of at least 1.1

Good: Image density of at least 1.0 and less than 1.1

Poor: Image density of less than 1.0

(Evaluation of Blocking Resistance)

A value for blocking resistance of the toner particles was calculated by leaving 3 g of the toner to stand for 3 hours at 60° C., sifting the toner for 30 seconds using a vibrating 200 mesh sieve, and calculating blocking resistance from an amount of sieve residue. Blocking resistance was evaluated in accordance with the following evaluation standard.

Good: No greater than 20%

Poor: Greater than 20%

(Evaluation of Polymerization Stability)

With respect to each of the toners according to Examples 1-8 and Comparative Examples 1 and 2, another toner was prepared according to the same method in all aspects other than that the temperature was maintained at 75° C. for 1 hour during the shell layer formation process instead of at 70° C. for 2 hours. A difference between a volume median particle size of the toner prepared at 75° C. and a volume median particle size of the toner prepared at 70° C. was calculated. Polymerization stability (tolerance of polymerization temperature) was evaluated in accordance with the following evaluation standard, based on the difference between the particle sizes.

Particularly good: Particle size difference of no greater than 0.1 μm

Good: Particle size difference of greater than 0.1 μm and no greater than 0.2 μm Poor: Particle size difference of greater than 0.2 μm

TABLE 1

| | Inorganic particles added to toner core surfaces | | Amount of Mirbane during capsulation | Shell layer film thickness | BET specific surface area ($m^2/g$) | Average roundness | Image density after printing 2,000 sheets | | Blocking resistance evaluation result | Polymerization stability evaluation result |
|---|---|---|---|---|---|---|---|---|---|---|
| | Type | Amount | | | | | Image density | Evaluation result | | |
| Example 1 | Silica | 15 g | 2 mL | 6 nm | 1.209 | 0.968 | 1.22 | Particularly good | Good | Particularly good |
| Example 2 | Silica | 10 g | 2 mL | 6 nm | 1.114 | 0.971 | 1.19 | Particularly good | Good | Particularly good |

TABLE 1-continued

| | Inorganic particles added to toner core surfaces | | Amount of Mirbane during capsulation | Shell layer film thickness | BET specific surface area ($m^2/g$) | Average roundness | Image density after printing 2,000 sheets | | Blocking resistance evaluation result | Polymerization stability evaluation result |
|---|---|---|---|---|---|---|---|---|---|---|
| | Type | Amount | | | | | Image density | Evaluation result | | |
| Example 3 | Silica | 7.5 g | 2 mL | 6 nm | 1.020 | 0.974 | 1.15 | Particularly good | Good | Particularly good |
| Example 4 | Silica | 5 g | 2 mL | 6 nm | 0.964 | 0.977 | 1.05 | Good | Good | Particularly good |
| Example 5 | Silica | 10 g | 3 mL | 9 nm | 1.032 | 0.968 | 1.16 | Particularly good | Good | Particularly good |
| Example 6 | Silica | 10 g | 4 mL | 12 nm | 0.967 | 0.965 | 1.04 | Good | Good | Particularly good |
| Example 7 | Titanium oxide | 10 g | 2 mL | 6 nm | 1.020 | 0.971 | 1.13 | Particularly good | Good | Particularly good |
| Example 8 | Titanium oxide | 7.5 g | 2 mL | 6 nm | 0.967 | 0.972 | 1.04 | Good | Good | Good |
| Comparative Example 1 | None | | 2 mL | 6 nm | 0.937 | 0.975 | 0.89 | Poor | Good | Poor |
| Comparative Example 2 | Silica | 10 g | 6 mL | 17 nm | 0.942 | 0.966 | 0.95 | Poor | Good | Particularly good |

As shown in Table 1, the toners according to Examples 1-8 maintained image density after use and had excellent blocking resistance and polymerization stability. In contrast, the toners according to Comparative Examples 1 and 2 experienced a drop in image density after use and had inadequate polymerization stability.

What is claimed is:

1. An electrostatic latent image developing toner comprising toner particles that each include a toner mother particle, wherein the toner mother particle includes a toner core, a shell layer disposed over a surface of the toner core, and inorganic particles, the inorganic particles are located at an interface between the toner core and the shell layer, the shell layer contains a thermosetting component, the toner mother particle has a BET specific surface area of at least 0.95 $m^2/g$, the inorganic particles have an average particle size of at least 5 nm and no greater than 20 nm, the shell layer has a thickness of at least 1 nm and no greater than 15 nm, and the thickness of the shell layer is equal to or smaller than the average particle size of the inorganic particles.

2. The electrostatic latent image developing toner according to claim 1, wherein each of the toner particles further includes one or more types of inorganic particles, including at least silica, located on a surface of the toner mother particle.

3. The electrostatic latent image developing toner according to claim 1, wherein a surfactant is not present between the toner core and the shell layer.

4. The electrostatic latent image developing toner according to claim 1, wherein the toner mother particle has a BET specific surface area of at least 0.97 $m^2/g$.

5. The electrostatic latent image developing toner according to claim 1, wherein the toner particles have a volume average particle size of at least 4.0 μm and no greater than 10.0 μm.

6. The electrostatic latent image developing toner according to claim 1, wherein each of the toner particles further includes an external additive located on a surface of the toner mother particle.

7. A method of manufacturing the electrostatic latent image developing toner according to claim 1, comprising:

mixing toner cores with inorganic particles to attach the inorganic particles to the toner cores; and coating respective surfaces of the toner cores having the inorganic particles attached thereto with a thermosetting component.

8. The electrostatic latent image developing toner according to claim 1, wherein the inorganic particles include silica.

9. The electrostatic latent image developing toner according to claim 1, wherein the inorganic particles include titanium oxide.

10. The method according to claim 7, wherein the mixing toner cores with inorganic particles includes:

preparing an aqueous medium;

adding the toner cores to the aqueous medium;

adding the inorganic particles to the aqueous medium to which the toner cores have been added.

11. The method according to claim 10, further comprising:

adjusting pH of the aqueous medium before the coating respective surfaces of the toner cores.

12. The method according to claim 11, wherein in the adjusting pH, the aqueous medium is adjusted to pH 4 after the adding the inorganic particles to the aqueous medium.

13. The method according to claim 7, wherein in the coating respective surfaces of the toner cores, the thermosetting component is added to an aqueous medium without using a surfactant or a dispersant to form shell layers to coat respective surfaces of the toner cores.

* * * * *